US007722331B2

(12) United States Patent
Hirasawa et al.

(10) Patent No.: US 7,722,331 B2
(45) Date of Patent: May 25, 2010

(54) CONTROL SYSTEM FOR AIR-COMPRESSING APPARATUS

(75) Inventors: Takahisa Hirasawa, Fujisawa (JP); Kazumasa Kawasaki, Fujisawa (JP); Manabu Shindo, Chigasaki (JP); Tomohiro Nakamura, Machida (JP); Hiroshi Chikuma, Matsudo (JP)

(73) Assignee: Hitachi, Ltd., Tokyo (JP)

( * ) Notice: Subject to any disclaimer, the term of this patent is extended or adjusted under 35 U.S.C. 154(b) by 397 days.

(21) Appl. No.: 11/527,537

(22) Filed: Sep. 27, 2006

(65) Prior Publication Data

US 2007/0077151 A1 Apr. 5, 2007

(30) Foreign Application Priority Data

Sep. 30, 2005 (JP) ..... 2005-288642

(51) Int. Cl.
*F04B 41/06* (2006.01)
*F04B 49/06* (2006.01)

(52) U.S. Cl. ..... 417/5; 417/44.2

(58) Field of Classification Search ..... 417/3, 417/4, 5, 2

See application file for complete search history.

(56) References Cited

U.S. PATENT DOCUMENTS 1,970,380 A * 8/1934 Hosel ..... 417/3
2,080,232 A * 5/1937 Rogers et al. ..... 417/3
2,295,775 A * 9/1942 Crittenden ..... 417/3
2,312,728 A * 3/1943 O'Hagan et al. ..... 417/5
4,232,997 A * 11/1980 Grimmer et al. ..... 417/4
4,269,569 A * 5/1981 Hoover ..... 417/5
5,259,731 A * 11/1993 Dhindsa et al. ..... 417/3
5,797,729 A * 8/1998 Rafuse et al. ..... 417/3
6,045,332 A * 4/2000 Lee et al. ..... 417/5
6,186,743 B1 * 2/2001 Romer ..... 417/3
6,233,954 B1 * 5/2001 Mehaffey et al. ..... 62/175
6,293,756 B1 * 9/2001 Andersson ..... 417/3
6,419,454 B1 * 7/2002 Christiansen ..... 417/4
2002/0106280 A1 * 8/2002 Beard et al. ..... 417/3

FOREIGN PATENT DOCUMENTS

EP 0 213 092 A2 3/1987
JP 8-296566 A 11/1996
JP 2003-21072 1/2003
JP 2003-35273 2/2003

OTHER PUBLICATIONS

Japanese Office Action dated Nov. 27, 2009 (Three (3) pages).

* cited by examiner

*Primary Examiner*—Devon C Kramer
*Assistant Examiner*—Bryan Lettman
(74) *Attorney, Agent, or Firm*—Crowell & Moring LLP

(57) ABSTRACT

An air-compressing apparatus has four compressors individually supplying compressed air to a tank having a pressure sensor. The pressure sensor is connected to control circuits of the compressors. The control circuits compute times needed for the tank pressure to reach minimum and maximum pressures, respectively, of the tank by using the detected tank pressure and also using a tank pressure change value. The computed time values correspond to the consumption of compressed air. Thus, the control circuits can control the number of compressors to be operated according to the consumption of compressed air.

14 Claims, 7 Drawing Sheets

COMMUNICATION
CONTROL CIRCUIT
CONTROL CIRCUIT
CONTROL CIRCUIT
CONTROL CIRCUIT
1
2A
2B
2C
2D
7A
7B
7C
7D
3A
3B
3C
3D
4A
4B
4C
4D
6A
6B
6C
6D
5A
5B
5C
5D
9A
9B
9C
9D
10A
10B
10C
10D
M
P
8
11
12
13
14
Pm
Tt
T

CONTROL SYSTEM FOR AIR-COMPRESSING APPARATUS

BACKGROUND OF THE INVENTION

1. Field of the Invention

The present invention relates to a control system suitable for use in an air-compressing apparatus including, for example a plurality of compressors that individually supply compressed air to a tank.

2. Description of Related Art

A generally known type of air-compressing apparatus has a plurality of compressors connected in parallel to a tank (for example, see Japanese Patent Application Publication Nos. 2003-21072 and 2003-35273). The air-compressing apparatus is provided with a pressure sensor to measure the pressure in the tank. The pressure value detected with the pressure sensor is compared with a plurality of predetermined control threshold values to perform loading/unloading control and start/stop control of each compressor. With this system, the number of compressors to be operated is varied according to the pressure in the tank to adjust the discharge flow rate of compressed air supplied to the tank.

The above-described prior art controls the number of compressors to be operated by comparing the detected value of the pressure in the tank with the control pressure values. Therefore, there are cases where an unnecessarily large number of compressors are operated because the detected tank pressure has become lower than a predetermined control threshold value despite a very low consumption of compressed air from the tank. There are also cases where a plurality of compressors are driven until the pressure in the tank reaches a maximum pressure irrespective of the consumption of compressed air. In such cases, the electric power is consumed wastefully.

It is also conceivable to provide a flow sensor in the output piping of the tank and to detect the consumption of compressed air with the flow sensor, thereby performing the compressor control according to the consumption of compressed air. In this case, however, an extra flow sensor needs to be provided, and the installation of the flow sensor increases the number of man-hours. Therefore, the production cost increases unfavorably.

SUMMARY OF THE INVENTION

The present invention has been made in view of the above-described problems with the prior art.

Accordingly, an object of the present invention is to provide a control system for an air-compressing apparatus that controls the discharge volume (flow rate) of the air-compressing apparatus according to the consumption of compressed air without using a flow sensor, thereby enabling the power consumption to be reduced.

To solve the above-described problem, the present invention is applied to a control system for an air-compressing apparatus having a plurality of air compressors that compress air and discharge the compressed air, a tank that stores the compressed air from the air compressors, pressure detecting means that detects the pressure in the tank, and control means that controls the discharge flow rate of the air compressors by increasing or decreasing the number of air compressors to be operated according to the pressure in the tank detected by the pressure detecting means.

According to one feature of the present invention, the control means controls the number of air compressors to be operated according to the magnitude of an increasing rate per unit time of the pressure in the tank detected by the pressure detecting means such that the number of air compressors to be operated tends to decrease more significantly when the increasing rate is high as compared to when it is low.

Thus, according to the present invention, the control means controls the number of air compressors to be operated according to the magnitude of the increasing rate per unit time of the pressure in the tank detected by the pressure detecting means such that the number of air compressors to be operated tends to decrease more significantly when the increasing rate is high as compared to when it is low, whereby the number of air compressors to be operated is controlled according to the consumption of compressed air, and thus the discharge flow rate of compressed air can be adjusted. As a result, it becomes possible for the air-compressing apparatus to suppress an unnecessary discharge of compressed air exceeding the consumption thereof, and hence the power consumption of the air-compressing apparatus can be reduced.

In addition, because the pressure in the tank is used for the control, it is unnecessary to provide a flow sensor in the output piping of the tank. Further, the pressure detecting means can use an existing pressure sensor provided in the tank. Therefore, the production cost can be minimized.

According to one feature of the present invention, the control means controls such that the tank pressure at which the number of air compressors to be operated is decreased according to the magnitude of the increasing rate is lower when the increasing rate is high than when it is low, thereby decreasing the pressure in the tank according to the consumption of compressed air. Thus, the power consumption of the air-compressing apparatus can be further reduced.

According to another feature of the present invention, the control means calculates from the increasing rate an upper limit arrival time needed for the pressure in the tank to reach an upper limit pressure. When the upper limit arrival time has become less than a predetermined time, the control means decreases the number of air compressors to be operated. Thus, when the consumption of compressed air is low, the upper limit arrival time becomes less than the predetermined time while the pressure in the tank is low. Consequently, the pressure in the tank can be held low, and the power consumption of the air-compressing apparatus can be further reduced.

According to still another feature of the present invention, the control means controls a tank pressure threshold value that decreases the number of air compressors to be operated according to the magnitude of the increasing rate such that the tank pressure threshold value reduces as the increasing rate increases. Thus, the increasing rate can be held low, and the power consumption of the air-compressing apparatus can be further reduced.

According to a further feature of the present invention, the control means decreases the number of air compressors to be operated when the increasing rate has exceeded a predetermined increasing rate. Thus, the increasing rate can be held low, and the power consumption of the air-compressing apparatus can be further minimized.

According to a still further feature of the present invention, the control means controls the number of air compressors to be operated according to the magnitude of a decreasing rate per unit time of the pressure in the tank detected by the pressure detecting means such that the number of air compressors to be operated tends to increase more significantly when the decreasing rate is high as compared to when it is low. Thus, the number of air compressors to be operated is adjusted according to the consumption of compressed air, and hence the discharge flow rate of compressed air can be adjusted. Consequently, when the consumption of compressed air is high and the decreasing rate is high, the number of air compressors to be operated is increased. Therefore, it is possible to prevent the pressure in the tank from becoming insufficient.

According to a still further feature of the present invention, the control means maintains the present operating condition as it is when one cycle consisting of uptime and downtime of one of the air compressors is shorter than a predetermined cycle time. Thus, it is possible to prevent one air compressor from repeating starting and stopping in a short period of time. Hence, the durability of the apparatus increases.

According to a still further feature of the present invention, the control means stops all the air compressors when the pressure in the tank has reached a predetermined upper limit pressure. By so doing, the tank pressure is prevented from becoming excessively high.

According to a still further feature of the present invention, the control means operates all the air compressors when the pressure in the tank is lower than a predetermined lower limit pressure. Thus, when the pressure in the tank is excessively low, the tank pressure can be increased in a stroke, whereby it is possible to prevent a shortage of air in the tank, which is an unallowable situation.

The above and other objects, features and advantages of the present invention will become more apparent from the following description of the preferred embodiments thereof, taken in conjunction with the accompanying drawings.

DETAILED DESCRIPTION OF THE INVENTION

Figure 1:
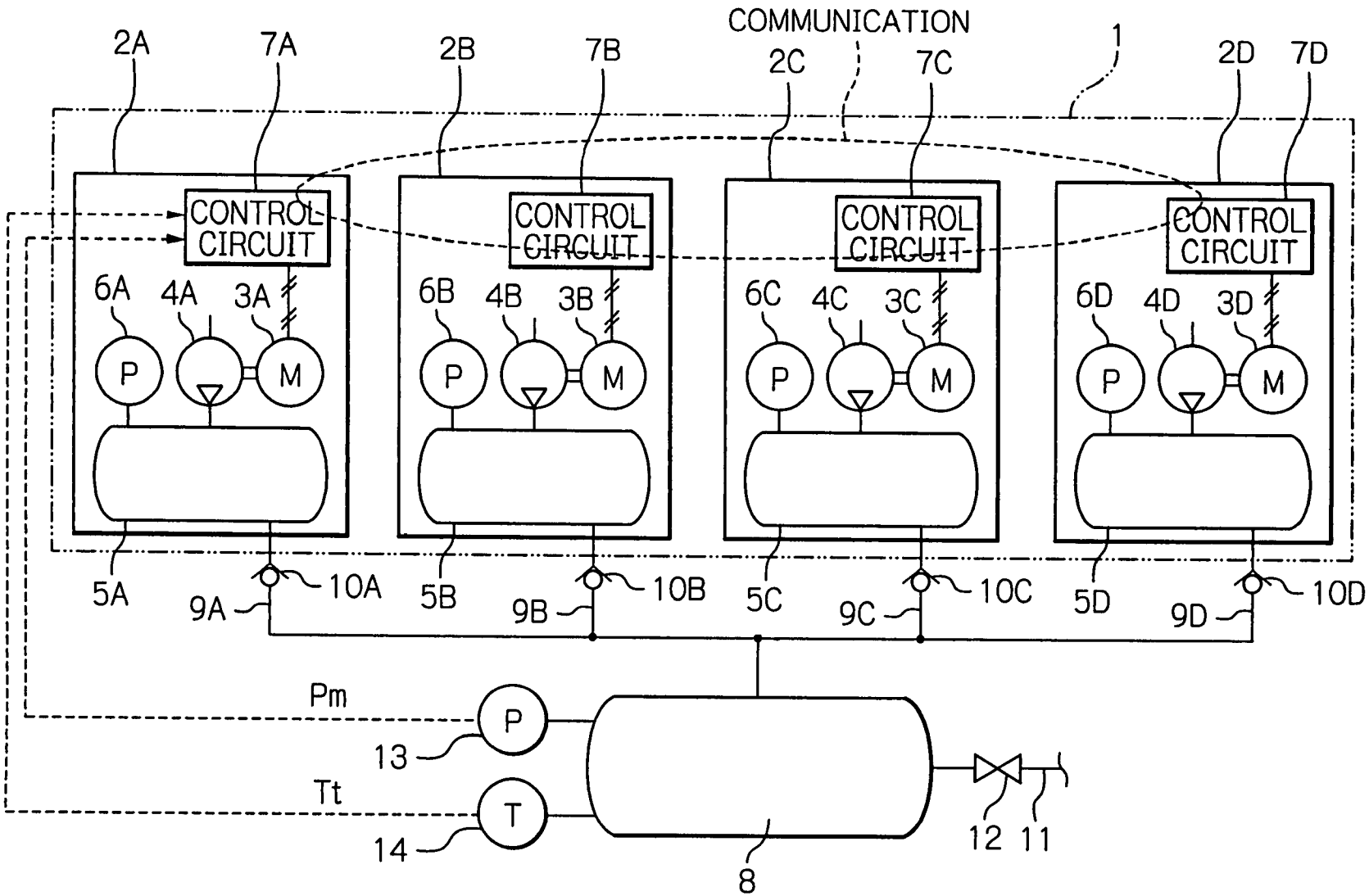
FIG. 1 is a block diagram showing the way in which an air-compressing apparatus according to a first embodiment of the present invention is connected to a tank.

Embodiments of the present invention will be explained, by way of example, below in detail with reference to the accompanying drawings with regard to an air-compressing apparatus using four compressors that individually supply compressed air to a tank.

FIGS. 1 to 4 show a first embodiment of the present invention. In the figures, an air-compressing apparatus 1 includes four compressors 2A to 2D. The compressor 2A consists essentially of an electric motor 3A, a compressor body 4A driven by the electric motor 3A, and a temporary storage tank 5A that temporarily stores compressed air discharged from the compressor body 4A. The other compressors 2B to 2D also have electric motors 3B to 3D, compressor bodies 4B to 4D, and temporary storage tanks 5B to 5D, respectively, as in the case of the compressor 2A. All the compressors 2A to 2D have the same discharge flow rate $F_a$ to $F_d$ [for example, $F_a$ to $F_d$=605 (NL/min)].

The temporary storage tanks 5A to 5D have respective pressure sensors 6A to 6D attached thereto to detect pressures therein. Further, the compressors 2A to 2D are provided with respective control circuits 7A to 7D to control the start and stop of the electric motors 3A to 3D. The control circuits 7A to 7D have respective communication sections, e.g. RS485, to communicate with each other through the communication sections.

The control circuits 7A to 7D transmit therebetween four kinds of information through communication, i.e. model information, operation information, abnormality information, and environment setting information. Thus, the control circuits 7A to 7D share the four kinds of information. In this regard, the model information includes the capacity (kW) of the electric motors 3A to 3D, the discharge flow rate (NL/min) of the compressor bodies 4A to 4D, the capacity (L) of the temporary storage tanks 5A to 5D, etc. The operation information includes the uptime (min) of the compressors 2A to 2D, the number of ON/OFF counts (number of times), etc. The abnormality information includes pieces of information such as a thermal trip error, and a drier error, which may interfere with the operation of the compressors 2A to 2D. The environment setting information includes the capacity (L) of a tank 8 (described later), the number of compressors 2A to 2D that are subjected to compressor control processing, the master switching time (min) taken to switch between a master and slaves, and a minimum pressure $P_{min}$ ($MP_a$) and a maximum pressure $P_{max}$ ($MP_a$) in the tank 8, which are set by a user. The environment setting information is input by an installation operator, for example, when installing the compressors 2A to 2D, the installation operator connects a special-purpose input terminal (not shown) to the control circuits 7A to 7D and inputs the required information. At this time, the environment setting information also includes the IDs (identification numbers) of the compressors 2A to 2D for communication, master/slave setting information, etc.

The arrangement may be such that the environment setting information is input not by using a special-purpose input terminal but by actuating a plurality of switches (not shown) mounted on the control circuits 7A to 7D. For example, the environment setting information may be input by using combined conditions of ON/OFF of the switches.

The control circuits 7A to 7D employ a distributed control system. That is, one of the compressors 2A to 2D is defined as a master (master compressor), and the other three compressors as slaves (slave compressors). With this master-slave control scheme, the control circuits 7A to 7D control the start and stop of the compressors 2A to 2D. Thus, the control circuits 7A to 7D constitute a control means to perform compressor control processing in which the number of compressors 2A to 2D to be operated is varied according to the pressure $P_m$ in the tank 8 and the pressure change valve ΔP, as will be stated later.

The tank 8 collects and stores compressed air discharged from the temporary storage tanks 5A to 5D. The tank 8 is connected to the temporary storage tanks 5A to 5D through discharge pipes 9A to 9D. Check valves 10A to 10D are provided in respective intermediate portions of the discharge pipes 9A to 9D. The tank 8 is equipped with output piping 11 having a delivery valve 12. Thus, the tank 8 is connected to external pneumatic equipment (not shown) through the output piping 11 and supplies compressed air to the pneumatic equipment when the delivery valve 12 is opened.

A pressure sensor 13 is connected to the tank 8 to serve as a pressure detecting means. The pressure sensor 13 detects the pressure $P_m$ of compressed air in the tank 8 and outputs a pressure signal corresponding to the pressure $P_m$.

A temperature sensor 14 is connected to the tank 8 to serve as a temperature detecting means. The temperature sensor 14 detects the temperature $T_t$ of compressed air in the tank 8 and outputs a temperature signal corresponding to the temperature $T_t$.

The pressure sensor 13 and the temperature sensor 14 are connected to the control circuits 7A to 7D of the compressors 2A to 2D. Thus, any of the control circuits 7A to 7D can sense the pressure $P_m$ and temperature $T_t$ in the tank 8.

It should be noted that the present invention is not necessarily limited to the arrangement where the pressure sensor 13 and the temperature sensor 14 are connected to all the control circuits 7A to 7D. The arrangement may be such that the pressure sensor 13 and the temperature sensor 14 are connected to only the control circuit 7A, for example. In this case, the control circuits 7A to 7D are looped so as to act like a current loop of 4 to 20 mA, for example, whereby the pressure signal and the temperature signal are output to the remaining control circuits 7B to 7D as well.

The air-compressing apparatus 1 according to this embodiment has the above-described arrangement. Next, compressor control processing in which the number of compressors 2A to 2D to be operated is varied according to the pressure $P_m$ in the tank 8 and so forth will be explained with reference to FIGS. 1 and 2.

Figure 2:
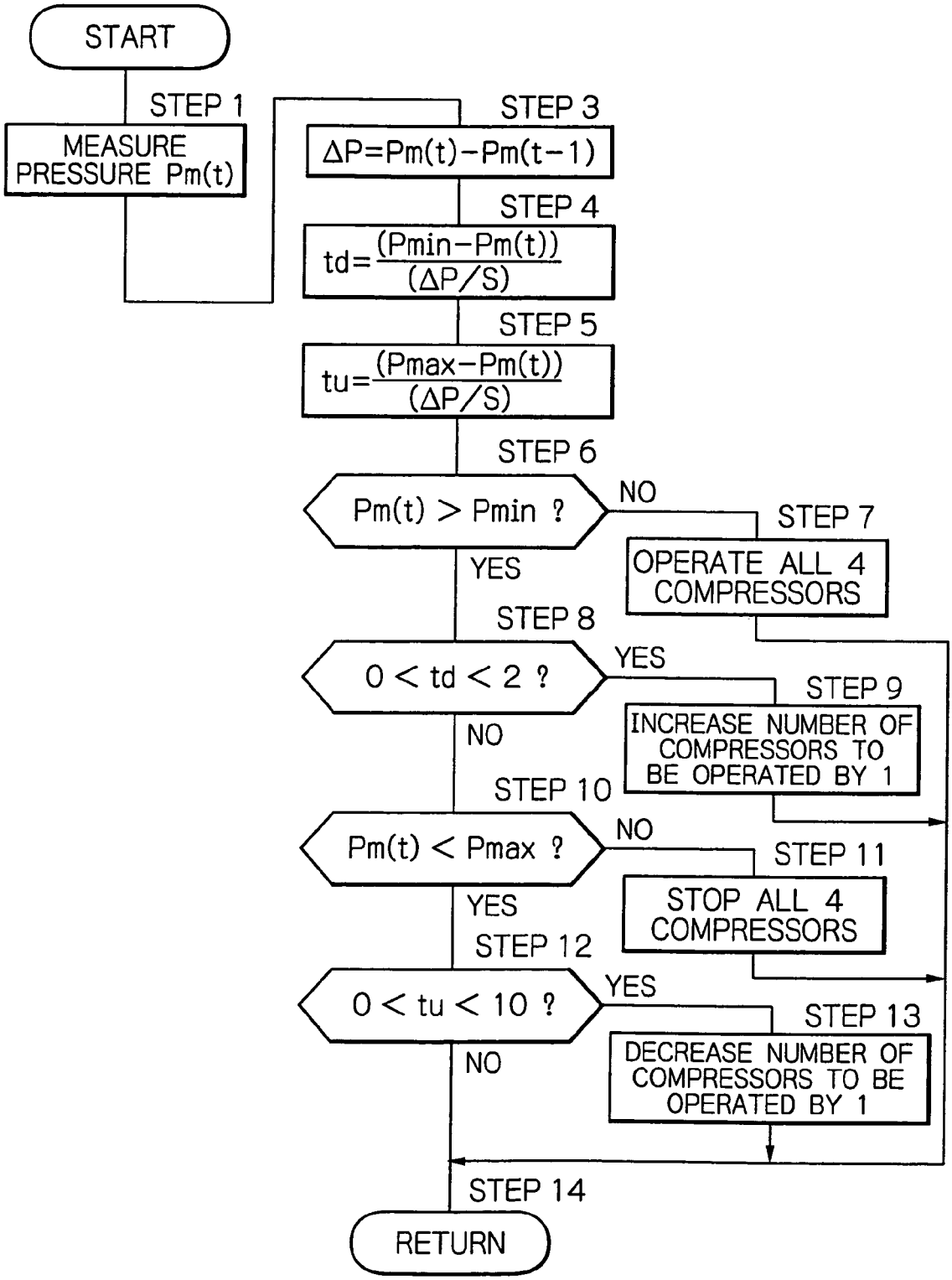
FIG. 2 is a flowchart showing compressor control processing executed by the air-compressing apparatus shown in FIG. 1.

It should be noted that the compressor control processing shown in FIG. 2 is executed every predetermined sampling period (e.g. 100 ms).

First, at step 1, the present pressure $P_m(t)$ in the tank 8 is measured at a predetermined sampling period by using the pressure signal from the pressure sensor 13.

Next, at step 3, a difference between the present pressure $P_m(t)$ and the previously measured pressure $P_m(t-1)$ is computed to obtain a pressure change value ΔP, as given by:

$$\Delta P = P_m(t) - P_m(t-1) \tag{1}$$

The pressure change value ΔP is a pressure increasing rate per sampling period if it is a positive value, but a pressure decreasing rate per sampling period if it is a negative value.

Next, at step 4, a difference between the minimum pressure $P_{min}$ (lower limit pressure) in the tank 8, which has been set by the user, and the present pressure $P_m(t)$ is divided by the pressure change value ΔP to obtain a time $t_d$ (lower limit arrival time) needed for the pressure $P_m(t)$ in the tank 8 to reach the minimum pressure $P_{min}$ under the present operating condition, as given by:

$$t_d = \frac{(P_{min} - P_m(t))}{(\Delta P / S)} \tag{2}$$

In expression (2), S represents the sampling period. The pressure change value ΔP is converted into a pressure change per unit time (one second) by dividing it by the sampling period S (e.g. 0.1 second). By this operation, the time $t_d$ is also calculated as a value in units of seconds.

Next, at step 5, a difference between the maximum pressure $P_{max}$ (upper limit pressure) in the tank 8, which has been set by the user, and the present pressure $P_m(t)$ is divided by the pressure change value ΔP to obtain a time $t_u$ (upper limit arrival time) needed for the pressure $P_m(t)$ in the tank 8 to reach the maximum pressure $P_{max}$ under the present operating condition in the same way as at step 4, as given by:

$$t_u = \frac{(P_{max} - P_m(t))}{(\Delta P / S)} \tag{3}$$

Next, at step 6, it is judged whether or not the present pressure $P_m(t)$ in the tank 8 is higher than the minimum pressure $P_{min}$ ($P_m(t) > P_{min}$). If "NO" is the answer at step 6, the pressure $P_m(t)$ in the tank 8 is lower than the minimum pressure $P_{min}$. Therefore, the control process proceeds to step 7 at which the compressors 2A to 2D are successively started until all the four compressors 2A to 2D are operating. Then, the process proceeds to step 14 to return to step 1.

If "YES" is the answer at step 6, the pressure $P_m(t)$ in the tank 8 is higher than the minimum pressure $P_{min}$. Therefore, the process proceeds to step 8 at which it is judged whether or not the time $t_d$ needed for the pressure $P_m(t)$ in the tank 8 to reach the minimum pressure $P_{min}$ under the present operating condition of the compressors 2A to 2D is between 0 and 2 seconds ($0 < t_d < 2$).

If "YES" is the answer at step 8, it is considered that the consumption of compressed air is more than the supply thereof, and the pressure $P_m(t)$ in the tank 8 will become lower than the minimum pressure $P_{min}$ within 2 seconds. Therefore, the process proceeds to step 9 at which the number of compressors 2A to 2D to be operated is increased by one. At this time, if the master compressor 2A is at rest, the compressor 2A is started first. If the master compressor 2A is operating, the slave compressors 2B to 2D that are at rest are started in a predetermined order (e.g. in the order of the compressor 2B, the compressor 2C, and the compressor 2D). After the number of compressors 2A to 2D to be operated has been increased by one, the process proceeds to step 14 to return to step 1.

If "NO" is the answer at step 8, it is considered that the pressure $P_m(t)$ is increasing, or if it is decreasing, it will take at least 2 seconds for the pressure $P_m(t)$ to reach the minimum pressure $P_{min}$. That is, it is considered that a supply of compressed air that is commensurate with the consumption thereof is ensured, and there is sufficient time before the pressure $P_m(t)$ reaches the minimum pressure $P_{min}$. Therefore, the process proceeds to step 10 at which it is judged whether or not the present pressure $P_m(t)$ in the tank 8 is lower than the maximum pressure $P_{max}$ ($P_m(t) < P_{max}$).

If "NO" is the answer at step 10, the pressure $P_m(t)$ in the tank 8 is higher than the maximum pressure $P_{max}$. Therefore, the process proceeds to step 11 at which the compressors 2A to 2D are immediately stopped until all the four compressors 2A to 2D are at rest. Then, the process proceeds to step 14 to return to step 1.

If "YES" is the answer at step 10, the pressure $P_m(t)$ in the tank 8 is lower than the maximum pressure $P_{max}$. Therefore, the process proceeds to step 12 at which it is judged whether or not the time $t_u$ needed for the pressure $P_m(t)$ in the tank 8 to reach the maximum pressure $P_{max}$ under the present operating condition of the compressors 2A to 2D is between 0 and 10 seconds ($0 < t_u < 10$).

If "YES" is the answer at step 12, it is considered that the supply of compressed air is excessively more than the consumption thereof, and the pressure $P_m(t)$ in the tank 8 will become higher than the maximum pressure $P_{max}$ within 10 seconds. Therefore, the process proceeds to step 13 at which the number of compressors 2A to 2D to be operated is decreased by one. At this time, if any of the slave compressors 2B to 2D are operating, the slave compressors 2B to 2D that are operating are stopped in a predetermined order (e.g. in the order of the compressor 2D, the compressor 2C, and the compressor 2B). If all the slave compressors 2B to 2D are at rest, the master compressor 2A is stopped. After the number of compressors 2A to 2D to be operated has been decreased by one, the process proceeds to step 14 to return to step 1.

If "NO" is the answer at step 12, it is considered that the pressure $P_m(t)$ is decreasing, or if it is increasing, it will take at least 10 seconds for the pressure $P_m(t)$ to reach the maximum pressure $P_{max}$. That is, it is considered that a supply of compressed air that is commensurate with the consumption thereof is ensured, and there is sufficient time before the pressure $P_m(t)$ reaches the maximum pressure $P_{max}$. Therefore, the present operating condition of the compressors 2A to 2D is maintained as it is, and the process proceeds to step 14 to return to step 1.

In the above-described compressor control processing, the control system has been described with the compressor 2A defined as a master and the compressors 2B to 2D as slaves. Master and slave compressors are, however, sequentially changed every predetermined time set by the user, for example. That is, the compressors 2A to 2D take turns serving as the master in the following order: the compressor 2A, the compressor 2B, the compressor 2C, and the compressor 2D. The compressor 2A serves as the master again in succession to the compressor 2D. When the master changes, the slave operating order also changes sequentially. Thus, it is possible to prevent such an unbalanced compressor operation that a particular one or ones of the compressors 2A to 2D are operated frequently, and hence possible to increase the durability of the compressors 2A to 2D.

It should be noted that if there is an abnormality in one of the compressors 2A to 2D, the compressor (e.g. the compressor 2D) in which an abnormality has occurred is excluded from the compressor control operation, and the remaining three compressors (e.g. the compressors 2A to 2C) are used to perform the compressor control operation. When there are abnormalities in two compressors, the remaining two compressors are used to perform the compressor control processing as in the case of the above.

Figure 3:
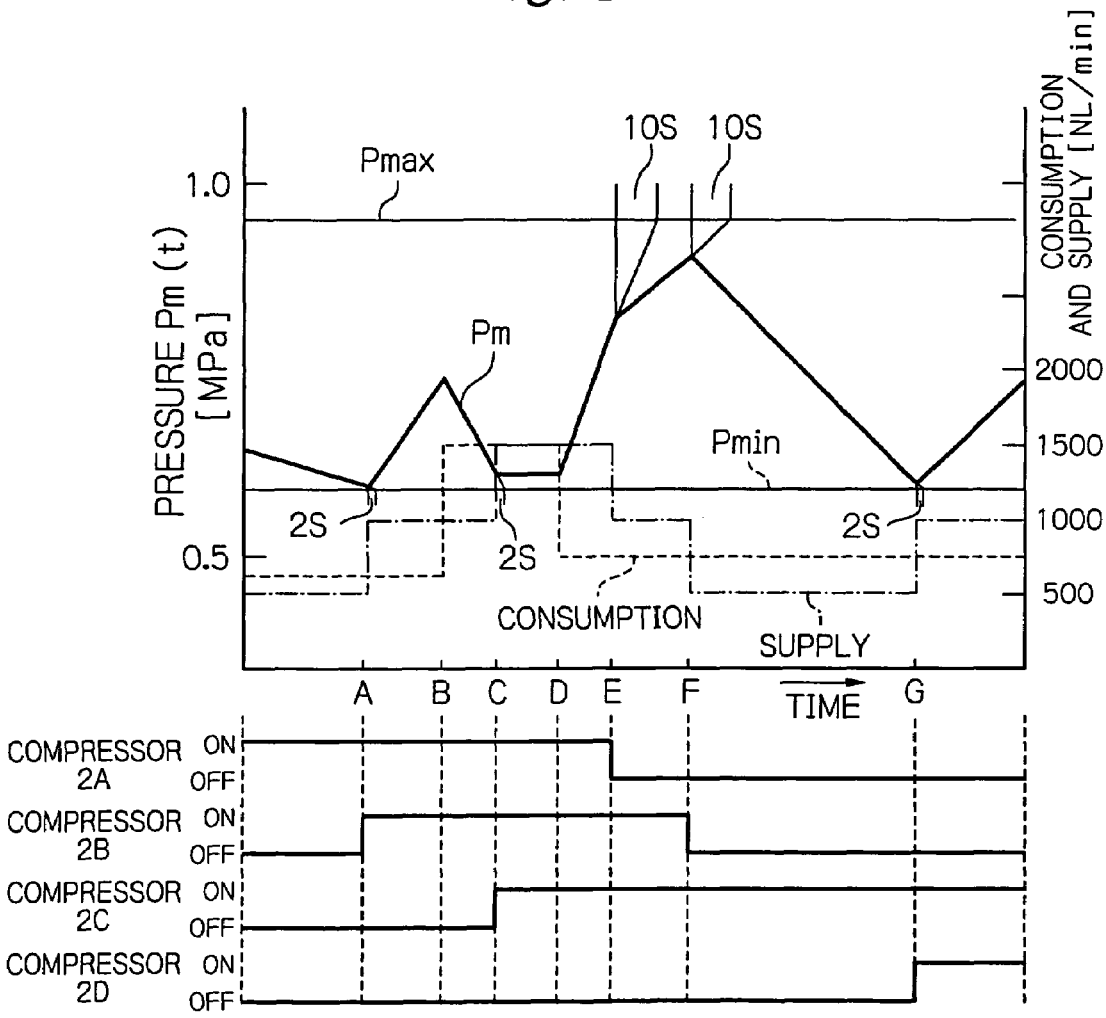
FIG. 3 is a characteristic chart showing changes with time of the supply and consumption of compressed air and the pressure in the tank.

The above examined the relationship between the pressure in the tank 8 and the supply and consumption of compressed air when the compressor control processing according to this embodiment was executed. One example thereof is shown in FIG. 3. It should be noted that FIG. 3 shows a state where the pressure $P_m$ in the tank 8 has previously been raised above the minimum pressure $P_{min}$ (set pressure set by the user).

As shown in FIG. 3, when the pressure $P_m$ in the tank 8 is slowly decreasing (until time A), that is, when the supply and consumption of compressed air are substantially balanced although the consumption is a little more than the supply, it is expected that the pressure $P_m$ will not rapidly become lower than the minimum pressure $P_{min}$ even if the present operating condition is maintained as it is. In this case, the pressure $P_m$ is expected to reach the minimum pressure $P_{min}$ in 2 seconds from time A. Therefore, the slave compressor 2B is started at time A, in addition to the operating compressor 2A. Consequently, the pressure $P_m$ in the tank 8 increases until time B. When the pressure $P_m$ in the tank 8 decreases more sharply, as during the time interval B to C, than during the time interval 0 to A, that is, when the consumption of compressed air is more than the supply thereof, it is expected that if the present operating condition is maintained as it is, the pressure $P_m$ will become lower than the minimum pressure $P_{min}$, resulting in the pneumatic equipment becoming unusable. Therefore, in this case, the compressor 2C is started at a higher pressure than the pressure at time A.

When the pressure $P_m$ in the tank 8 increases rapidly as during the time interval D to E, that is, when the supply of compressed air is greatly in excess of the consumption thereof, it is expected that there will be no substantial pressure reduction even if a compressor that is in operation is stopped. Therefore, in this case, the compressor 2C is stopped at a relatively low pressure at which the pressure $P_m$ in the tank 8 is expected to reach the maximum pressure $P_{max}$ in 10 seconds. Thereafter, when the pressure $P_m$ in the tank 8 is slowly increasing as during the time interval E to F, if a compressor that is in operation is stopped, it is expected that the balance between the consumption of compressed air and the supply thereof will be destroyed, resulting in the pressure $P_m$ decreasing sharply. Therefore, in this case, the slave compressor 2B is stopped at a relatively high pressure in the neighborhood of the maximum pressure $P_{max}$ (time F).

In the foregoing process, when a compressor is to be started to operate, the one which has been put in a non-operative condition for the longest time among the compressors 2A to 2D is selected in order to avoid that any of them repeats ON and Off states frequently.

Figure 4:
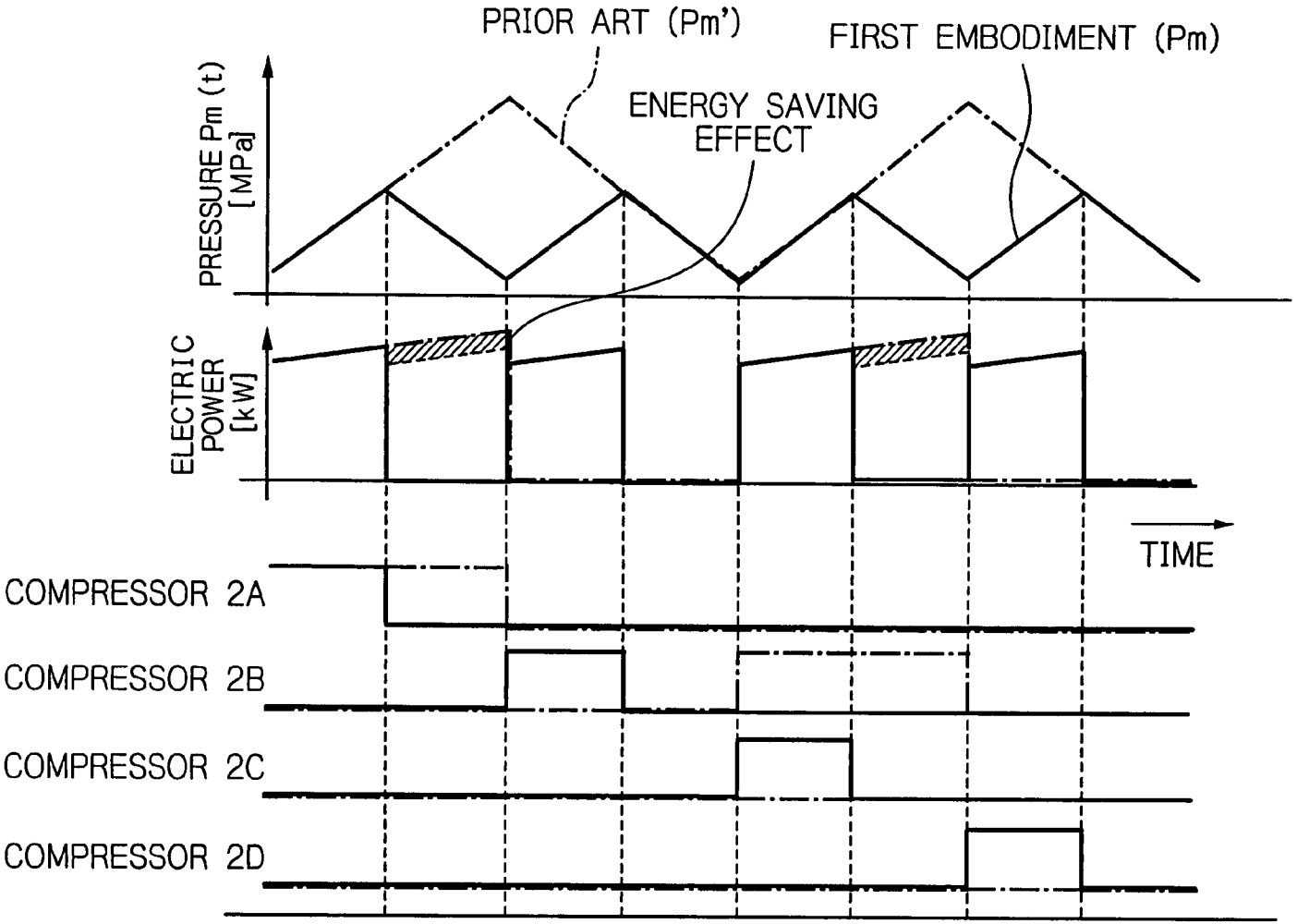
FIG. 4 is a characteristic chart showing changes with time of the pressure in the tank, etc. when the compressor control processing according to the first embodiment and that of the prior art are used.

We compared the prior art control in which the number of compressors to be operated is determined by using pressure threshold values and the compressor control processing according to this embodiment. The results of the comparison are shown in FIG. 4. It should be noted that the solid line in FIG. 4 represents the pressure $P_m$ in the tank 8 when the compressor control processing according to this embodiment was executed. The broken line in FIG. 4 represents the pressure $P_m'$ in the tank 8 when the compressor control according to the prior art was performed.

It will be understood from FIG. 4 that, with the compressor control processing according to this embodiment, the compressors 2A to 2D are operated generally in regions where the pressure $P_m$ is low, i.e. in regions where the power consumption is low. Let us compare the electric power consumed in both cases in FIG. 4. The power used in the embodiment is lower than that in the prior art (see, oblique line pattern portions in FIG. 4).

Thus, according to this embodiment, the control circuits 7A to 7D measure the pressure $P_m$ in the tank 8 before and after a predetermined time (sampling period S) by using the pressure sensor 13, compute a difference between the measured values of the tank pressure $P_m$ to obtain a pressure change value Δ, and set an optimum discharge flow for the air-compressing apparatus 1. More specifically, a time $d_d$ needed for the tank pressure to reach the minimum pressure $P_{min}$ and a time $t_u$ needed for the tank pressure to reach the maximum pressure $P_{max}$ are computed by using the pressure change value ΔP, and the number of compressors 2A to 2D to be operated is controlled by using the times $t_d$ and $t_u$. Because the pressure change value ΔP changes in accordance with the supply and consumption of compressed air, the control circuits 7A to 7D can adjust the discharge flow rate of the air-compressing apparatus 1 according to the consumption of compressed air.

In the prior art, the discharge flow rate of the air-compressing apparatus 1 is controlled by comparing the pressure $P_m$ in the tank 8 with predetermined pressure threshold values, whereas, in this embodiment, the discharge flow rate of the air-compressing apparatus 1 is controlled on the basis of the pressure change value ΔP. Therefore, in this embodiment, even when the pressure $P_m$ in the tank 8 is decreasing, the starting of the compressors 2A to 2D can be delayed to a time point at which the pressure $P_m$ is expected to reach a neighborhood of the set value (minimum pressure $P_{min}$) set by the user, provided that the consumption of compressed air is low. Further, in this embodiment, when the pressure $P_m$ in the tank 8 is increasing, the compressors 2A to 2D can be stopped before the pressure $P_m$ reaches the maximum pressure $P_{max}$, provided that the consumption of compressed air is low. Consequently, the air-compressing apparatus 1 can suppress unnecessary discharge of compressed air exceeding the consumption thereof, and hence the power consumption of the air-compressing apparatus 1 can be minimized.

Because the control circuits 7A to 7D set an optimum discharge flow rate for the air-compressing apparatus 1 by using the pressure change value ΔP, no flow sensor needs to be provided in the output piping 11 of the tank 8. Because the discharge flow rate of the air-compressing apparatus 1 can be controlled by using the existing pressure sensor 13, which is provided in the tank 8, the overall production cost of the apparatus can be minimized.

Further, the control circuits 7A to 7D set an optimum discharge flow rate for the air-compressing apparatus 1 by varying the number of compressors 2A to 2D to be operated. Therefore, when the consumption of compressed air is more than the supply thereof, the number of compressors to be operated can be increased. When the consumption of compressed air is less than the supply thereof, the number of compressors to be operated can be decreased.

The compressors 2A to 2D can be started individually (one at a time). Therefore, it is possible to prevent a rapid increase in the power supply load that would otherwise occur when a plurality of compressors 2A to 2D are simultaneously started.

Because the control circuits 7A to 7D are arranged to share abnormality information on the compressors 2A to 2D through communication, any of the compressors 2A to 2D in which an abnormality has occurred can be excluded from the compressor control operation. Therefore, if there is an abnormality in one compressor (e.g. the compressor 2D), the remaining compressors (e.g. the compressors 2A to 2C) can be used to perform the compressor control operation.

It should be noted that the values of the predetermined range of the lower limit arrival time, i.e. from 0 to 2 seconds, at step 8, and the values of the predetermined range of the upper limit arrival time, i.e. from 0 to 10 seconds, at step 12, are not particularly limited to these but may be set at will. If the lower limit arrival time (2 seconds) is increased, the average tank pressure increases. If the upper limit arrival time (10 seconds) is increased, the average tank pressure decreases. Accordingly, a desired average tank pressure can be set by setting of the upper limit arrival time and the lower limit arrival time.

In the above-described first embodiment, the compressor control is performed by using the upper limit arrival time and the lower limit arrival time. In this regard, when the magnitude of the increasing rate per unit time of the pressure in the tank is large, the upper limit arrival time shortens, and consequently, the number of compressors to be operated is decreased even when the tank pressure is low. This practically means that the number of compressors to be operated is varied according to the magnitude of the rate of change (increasing rate and decreasing rate).

Although in the first embodiment the temporary storage tanks 5A to 5D are provided by way of example, it should be noted that the temporary storage tanks 5A to 5D are not particularly necessary. The tank 8 may be provided alone without the temporary storage tanks 5A to 5D. In this case, all the equipment may be housed in a casing and controlled by a single control unit board.

Figure 5:
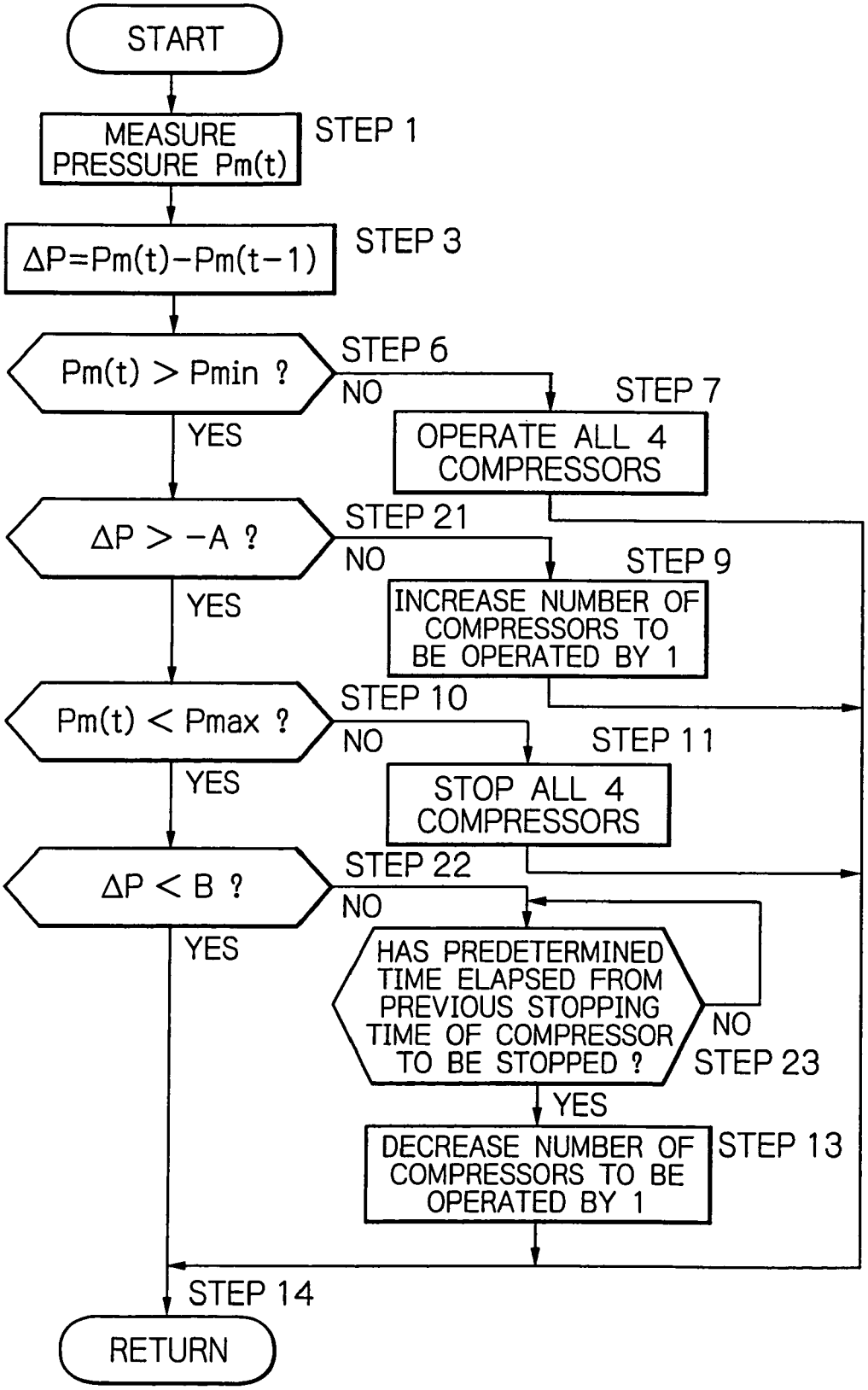
FIG. 5 is a flowchart showing compressor control processing according to a second embodiment of the present invention.

FIG. 5 shows a second embodiment of the present invention. The feature of the second embodiment resides in a control method that is different from that shown in FIG. 2. It should be noted that in this embodiment the same constituent elements as those in the first embodiment are denoted by the same reference numerals, and a detailed description thereof is omitted.

First, at step 1, the present pressure $P_m(t)$ in the tank 8 is measured at a predetermined sampling period by using a pressure signal from the pressure sensor 13.

Next, at step 3, a difference between the present pressure $P_m(t)$ and the previously measured pressure $P_m(t-1)$ is computed to obtain a pressure change value ΔP. The pressure change value ΔP is a pressure increasing rate per sampling period if it is a positive value, but a pressure decreasing rate per sampling period if it is a negative value.

Next, at step 6, it is judged whether or not the present pressure $P_m(t)$ is higher than the minimum pressure $P_{min}$. If "NO" is the answer at step 6, the control process proceeds to step 7 at which the compressors 2A to 2D are successively started until all the four compressors 2A to 2D are operating. Then, the process proceeds to step 14 to return to step 1.

If "YES" is the answer at step 6, the process proceeds to step 21 at which it is judged whether or not the pressure change value ΔP is larger than a preset value −A. If "YES" is the answer at step 21, the pressure change value ΔP is a negative small value, which means that the decreasing rate per unit time of the tank pressure is smaller than the predetermined value A.

The predetermined value A is a slightly smaller value than a pressure change value obtained when one compressor operates for the sampling period at a tank pressure in the neighborhood of the minimum pressure $P_{min}$. Thus, the tank pressure can be changed to the direction in which it increases by starting one compressor to operate.

If "NO" is the answer at step 21, the consumption of compressed air is more than the supply thereof. Therefore, the process proceeds to step 9 at which the number of compressors 2A to 2D to be operated is increased by one.

If "YES" is the answer at step 21, it is considered that the pressure $P_m(t)$ is increasing, or even if it is decreasing, the decreasing rate is low. That is, it is considered that a supply of compressed air that is commensurate with the consumption thereof is ensured, and there is sufficient time before the pressure $P_m(t)$ reaches the minimum pressure $P_{min}$. Therefore, the process proceeds to step 10 at which it is judged whether or not the present pressure $P_m(t)$ in the tank 8 is lower than the maximum pressure $P_{max}$.

If "NO" is the answer at step 10, the pressure $P_m(t)$ in the tank 8 is higher than the maximum pressure $P_{max}$. Therefore, the process proceeds to step 11 at which the compressors 2A to 2D are immediately stopped until all the four compressors 2A to 2D are at rest. Then, the process proceeds to step 14 to return to step 1.

If "YES" is the answer at step 10, the pressure $P_m(t)$ in the tank 8 is lower than the maximum pressure $P_{max}$.

Therefore, the process proceeds to step 22 at which it is judged whether or not the pressure change value ΔP is smaller than a preset value B. If "NO" is the answer at step 22, the pressure change value ΔP is a positive large value, which means that the increasing rate per unit time of the tank pressure is larger than the predetermined value B.

The predetermined value B is a slightly larger value than a pressure change value obtained when one compressor operates for the sampling period at a tank pressure in the neighborhood of the maximum pressure $P_{max}$. Thus, the tank pressure can be maintained in the increasing direction without a reduction in the tank pressure even if the operation of one compressor is suspended.

If "NO" is the answer at step 22, it is considered that the supply of compressed air is excessively more than the consumption thereof. Therefore, the process proceeds to step 13 at which the number of compressors 2A to 2D to be operated is decreased by one. Before step 13, it is checked at step 23 whether or not a time duration obtained by totaling the time elapsed from the previous stopping time point (i.e. one cycle consisting of uptime and downtime) of a compressor that is to be stopped at step 13 has exceeded a predetermined time (e.g. 1 minute). The compressor to be stopped is not actually stopped until the time elapsed from the previous stopping time point has exceeded the predetermined time.

The reason for the above is that if starting and stopping are repeated in an extremely short period of time, the service lifetime of the motors and the switches is reduced unfavorably.

At step 13, if any of the slave compressors 2B to 2D are operating, the slave compressors 2B to 2D that are operating are stopped in a predetermined order (e.g. in the order of the compressor 2D, the compressor 2C, and the compressor 2B). If all the slave compressors 2B to 2D are at rest, the master compressor 2A is stopped. After the number of compressors 2A to 2D to be operated has been decreased by one, the process proceeds to step 14 to return to step 1.

If "YES" is the answer at step 22, it is considered that the pressure $P_m(t)$ is decreasing, or if it is increasing, it will take some time for the pressure $P_m(t)$ to reach the maximum pressure $P_{max}$. That is, it is considered that a supply of compressed air that is commensurate with the consumption thereof is ensured, and there is sufficient time before the pressure $P_m(t)$ reaches the maximum pressure $P_{max}$. Therefore, the present operating condition of the compressors 2A to 2D is maintained as it is, and the process proceeds to step 14 to return to step 1.

Thus, in the second embodiment, the number of compressors to be operated is increased or decreased according to the increasing rate or the decreasing rate of the pressure in the tank 8. As a result, the increasing rate or the decreasing rate is controlled to have a small value. Consequently, the supply and consumption of compressed air are controlled to values close to each other. Hence, the power consumption of the air-compressing apparatus 1 can be minimized.

At step 23, a compressor that is to be stopped is kept from stopping until a predetermined time duration has elapsed from the previous stopping time point of the compressor to be stopped. Accordingly, it is possible to prevent one compressor from repeating starting and stopping in a short period of time and hence possible to increase the service lifetime of the equipment.

It should be noted that step 23 in the second embodiment may be put before step 13 in the first embodiment.

Figure 6:
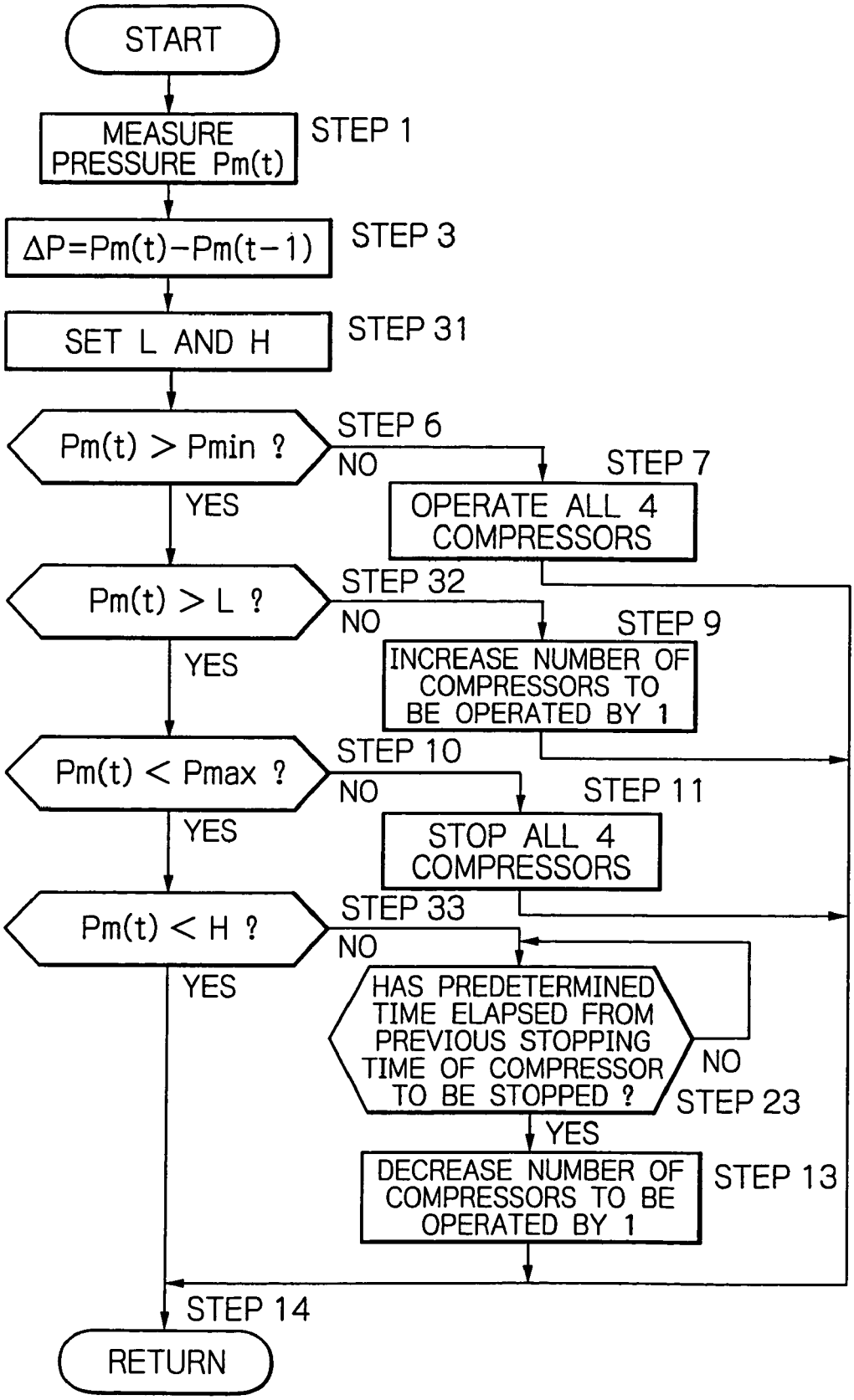
FIG. 6 is a flowchart showing compressor control processing according to a third embodiment of the present invention.
Figure 7:
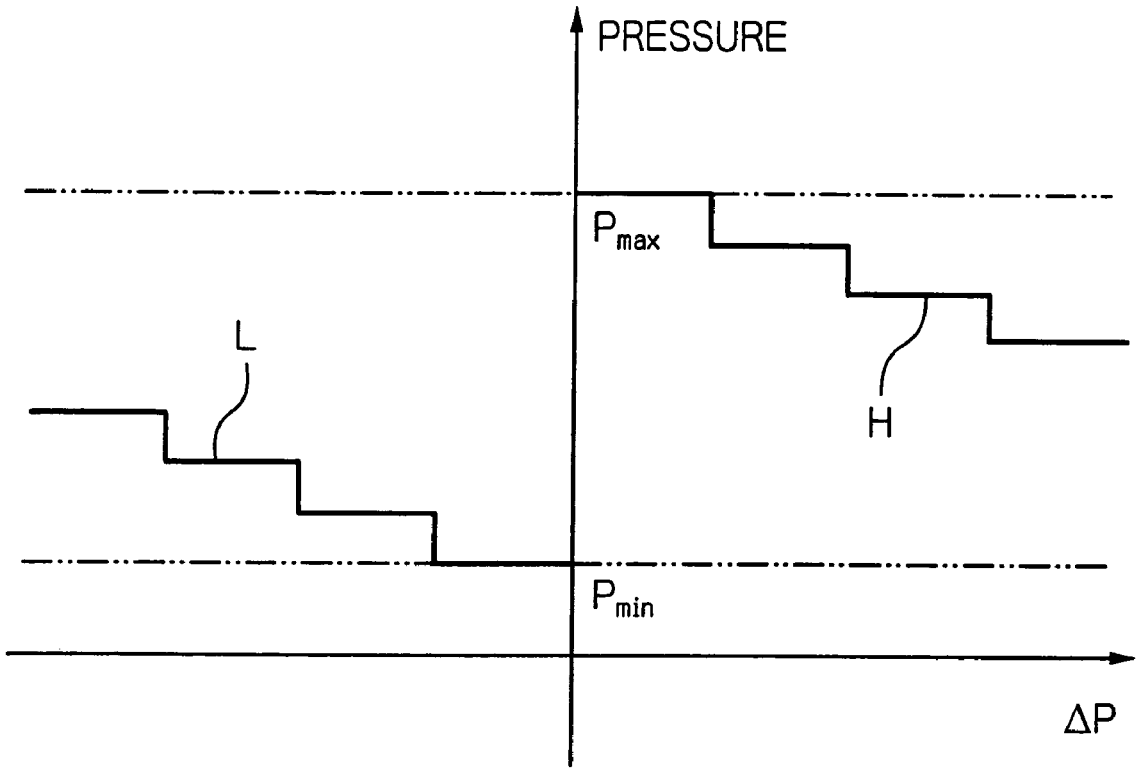
FIG. 7 is a control map showing the relationship between a pressure change value ΔP, a number-of-compressor decreasing pressure threshold value H and a number-of-compressor increasing pressure threshold value L used in the third embodiment.

A third embodiment of the present invention is shown in FIGS. 6 and 7. The feature of the third embodiment resides in a control method that is different from those shown in FIGS. 2 and 5. It should be noted that in this embodiment the same constituent elements as those in the first and second embodiments are denoted by the same reference numerals, and a detailed description thereof is omitted.

First, at step 1, the present pressure $P_m(t)$ in the tank 8 is measured at a predetermined sampling period by using a pressure signal from the pressure sensor 13.

Next, at step 3, a difference between the present pressure $P_m(t)$ and the previously measured pressure $P_m(t-1)$ is computed to obtain a pressure change value ΔP. The pressure change value ΔP is a pressure increasing rate per sampling period if it is a positive value, but a pressure decreasing rate per sampling period if it is a negative value.

At step 31, a number-of-compressor decreasing pressure threshold value H and a number-of-compressor increasing pressure threshold value L are determined from the pressure change value ΔP. For this process, a map as shown in FIG. 7 is prepared in the control system in advance. According to the map, when the pressure change value ΔP is a positive value (i.e. the tank pressure is increasing), a number-of-compressor decreasing pressure threshold value H is set. When the pressure change value ΔP is a negative value (i.e. the tank pressure is decreasing), a number-of-compressor increasing pressure threshold value L is set. Regarding the number-of-compressor decreasing pressure threshold value H, the larger the pressure change value ΔP (i.e. the higher the increasing rate of the tank pressure), the smaller the pressure threshold value H is set. With regard to the number-of-compressor increasing pressure threshold value L, the smaller the pressure change value ΔP (i.e. the higher the decreasing rate of the tank pressure), the larger the pressure threshold value L is set. The reason for this is that the higher the rate of change, the more rapidly the number of compressors to be operated should be increased or decreased, thereby controlling the supply and consumption of compressed air to values close to each other.

Next, at step 6, it is judged whether or not the pressure $P_m(t)$ is higher than the minimum pressure $P_{min}$. If "NO" is the answer at step 6, the control process proceeds to step 7 at which the compressors 2A to 2D are successively started until all the four compressors 2A to 2D are operating. Then, the process proceeds to step 14 to return to step 1.

If "YES" is the answer at step 6, the process proceeds to step 32 at which it is judged whether or not the present pressure $P_m(t)$ is higher than the number-of-compressor increasing pressure threshold value L.

If "NO" is the answer at step 32, the consumption of compressed air is more than the supply thereof, and the pressure $P_m(t)$ is approaching the lower limit of the tank pressure. Therefore, the process proceeds to step 9 at which the number of compressors 2A to 2D to be operated is increased by one.

If "YES" is the answer at step 32, it is considered that the pressure $P_m(t)$ is increasing, or if it is decreasing, the tank pressure is still high. That is, it is considered that a supply of compressed air that is commensurate with the consumption thereof is ensured, and there is sufficient time before the pressure $P_m(t)$ reaches the minimum pressure $P_{min}$. Therefore, the process proceeds to step 10 at which it is judged whether or not the present pressure $P_m(t)$ in the tank 8 is lower than the maximum pressure $P_{max}$.

If "NO" is the answer at step 10, the pressure $P_m(t)$ in the tank 8 is higher than the maximum pressure $P_{max}$. Therefore, the process proceeds to step 11 at which the compressors 2A to 2D are immediately stopped until all the four compressors 2A to 2D are at rest. Then, the process proceeds to step 14 to return to step 1.

If "YES" is the answer at step 10, the pressure $P_m(t)$ in the tank 8 is lower than the maximum pressure $P_{max}$.

Then, the process proceeds to step 33 at which it is judged whether or not the present pressure $P_m(t)$ is lower than the number-of-compressor decreasing pressure threshold value H.

If "NO" is the answer at step 33, it is considered that the supply of compressed air is excessively more than the consumption thereof. Therefore, the process proceeds to step 13 at which the number of compressors 2A to 2D to be operated is decreased by one. Before step 13, it is checked at step 23 whether or not a time duration obtained by totaling the time elapsed from the previous stopping time point (i.e. one cycle consisting of uptime and downtime) of a compressor that is to be stopped at step 13 has exceeded a predetermined time (e.g. 1 minute). The compressor to be stopped is not stopped until the time elapsed from the previous stopping time point has exceeded the predetermined time.

The reason for the above is that if starting and stopping are repeated in an extremely short period of time, the service lifetime of the motors and the switches is reduced unfavorably.

At step 13, if any of the slave compressors 2B to 2D are operating, the slave compressors 2B to 2D that are operating are stopped in a predetermined order (e.g. in the order of the compressor 2D, the compressor 2C, and the compressor 2B). If all the slave compressors 2B to 2D are at rest, the master compressor 2A is stopped. After the number of compressors 2A to 2D to be operated has been decreased by one, the process proceeds to step 14 to return to step 1.

If "YES" is the answer at step 33, it is considered that the pressure $P_m(t)$ is decreasing, or if it is increasing, it will take some time for the pressure $P_m(t)$ to reach the maximum pressure $P_{max}$. That is, it is considered that a supply of compressed air that is commensurate with the consumption thereof is ensured, and there is sufficient time before the pressure $P_m(t)$ reaches the maximum pressure $P_{max}$. Therefore, the present operating condition of the compressors 2A to 2D is maintained as it is, and the process proceeds to step 14 to return to step 1.

Thus, in the third embodiment, the threshold values for increasing or decreasing the number of compressors to be operated are changed according to the increasing rate or the decreasing rate of the pressure in the tank 8. As a result, the increasing rate or the decreasing rate is controlled to have a small value. Consequently, the supply and consumption of compressed air are controlled to values close to each other. Hence, the power consumption of the air-compressing apparatus 1 can be minimized.

Although in the air-compressing apparatus according to the foregoing embodiments the four compressors have the same discharge flow rate $F_a$ to $F_d$, it should be noted that the present invention is not necessarily limited thereto. Each compressor may have a different discharge flow rate. In this case, even finer control can be achieved by appropriately combining the compressors with each other.

It is possible in the present invention to use reciprocating, rotary-screw, scroll, and other types of compressors. These compressors may be used in combination.

Although the foregoing embodiments show an example in which the compressors are either operated or stopped, the present invention is not necessarily limited to the described example. In the case of unloadable compressors such as reciprocating compressors, the control system may be arranged as follows. When the number of compressors to be operated is to be decreased, an unloading operation is performed for a predetermined period of time. Thereafter, the compressor to be stopped is stopped.

It should be noted that the present invention is not necessarily limited to the foregoing embodiments but can be modified in a variety of ways without departing from the gist of the present invention.

What is claimed is:

1. A control system for an air-compressing apparatus comprising:

a plurality of air compressors that compress air and discharge compressed air;

a tank that stores the compressed air from said plurality of air compressors;

a pressure detecting unit that detects a pressure in said tank; and a control unit that controls a discharge flow rate of said plurality of air compressors by increasing or decreasing a number of said plurality of air compressors to be operated according to the pressure in said tank detected by said pressure detecting unit; wherein said control unit controls the number of said plurality of air compressors to be operated according to a rate of increase over time of the pressure in said tank detected by said pressure detecting unit such that the number of said plurality of air compressors to be operated decreases more significantly when the rate of increase is high as compared to when the rate of increase is low, and said control unit controls such that the number of said plurality of air compressors to be operated is decreased at lower pressure in the tank, when the rate of increase is high as compared to when the rate of increase is low;

said control unit calculates from the increasing rate an upper limit arrival time needed for the pressure in said tank to reach an upper limit pressure; and said control unit decreases the number of said plurality of air compressors to be operated when the upper limit arrival time is less than a predetermined time.

2. A control system for an air-compressing apparatus comprising:

a plurality of air compressors that compress air and discharge compressed air;

a tank that stores the compressed air from said plurality of air compressors;

a pressure detecting unit that detects a pressure in said tank; and a control unit that controls a discharge flow rate of said plurality of air compressors by increasing or decreasing a number of said plurality of air compressors to be operated according to the pressure in said tank detected by said pressure detecting unit; wherein said control unit controls the number of said plurality of air compressors to be operated according to a rate increase over time of the pressure in said tank detected by said pressure detecting unit such that the number of said plurality of air compressors to be operated decreases more significantly when the rate of increase is high as compared to when the rate of increase is low, and said control unit controls such that the number of said plurality of air compressors to be operated is decreased at lower pressure in the tank, when the rate of is high as compared to when the rate of increase is low;

said control unit controls a tank pressure threshold value such that the tank pressure threshold value decreases as the rate of increase increase; and the control unit decreases the number of said plurality of air compressors to be operated when the pressure in said tank exceeds the tank pressure threshold value.

3. The control system according to claim 1, wherein said control unit decreases the number of said plurality of air compressors to be operated when the increasing rate has exceeded a predetermined increasing rate.

4. The control system according to claim 1, wherein said control unit controls the number of said plurality of air compressors to be operated according to a magnitude of a decreasing rate per unit time of the pressure in said tank detected by said pressure detecting unit such that the number of said plurality of air compressors to be operated increases more significantly when the decreasing rate is high as compared to when the decreasing rate is low.

5. The control system according to claim 1, wherein said control unit maintains a present operating condition when a cycle consisting of an uptime and a downtime of one of said plurality of air compressors is shorter than a predetermined cycle time.

6. The control system according to claim 1, wherein said control unit stops all of said plurality of air compressors when the pressure in said tank has reached a predetermined upper limit pressure.

7. The control system according to claim 1, wherein said control unit operates all of said plurality of air compressors when the pressure in said tank is lower than a predetermined lower limit pressure.

8. A control system for air-compressing apparatus comprising:

a plurality of air compressors that compress air and discharge compressed air;

a tank that stores the compressed air from said plurality of air compressors;

a pressure detecting unit that detects a pressure in said tank; and a control unit that controls a discharge flow rate of said plurality of air compressors by increasing or decreasing a number of said plurality of air compressors to be operated according to the pressure in said tank detected by said pressure detecting unit; wherein said control unit controls the number of said plurality of air compressors to be operated according to a rate of increase over time of the pressure in said tank detected by said pressure detecting unit such that the number of said plurality of air compressors to be operated decreases more significantly when the rate of increase is high as compared to when the rate of increase is low, and said control unit controls such that the number of said plurality of air compressors to be operated is decreased at lower pressure in the tank, when the rate of increase is high as compared to when the rate of increase is low;

said control unit controls the number of said plurality of air compressors to be operated according to a magnitude of a rate of decrease over time of the pressure in said tank detected by said pressure detecting unit such that the number of said plurality of air compressors to be operated increases more significantly when the rate of decrease is high as compared to when the rate of decrease is low;

said control unit calculates from the rate of decrease a lower limit arrival time needed for the pressure in said tank to reach a lower limit pressure; and said control unit increases the number of said plurality of air compressors to be operated when the lower limit arrival time is lower than a predetermined time.

9. A control system for an air-compressing apparatus comprising:

a plurality of air compressors that compress air and discharge compressed air;

a tank that stores the compressed air from said plurality of air compressors;

a pressure detecting unit that detects a pressure in said tank; and a control unit that controls a discharge flow rate of said plurality of air compressors by increasing or decreasing a number of said plurality of air compressors to be operated according to the pressure in said tank detected by said pressure detecting unit; wherein said control unit controls the number of said plurality of air compressors to be operated according to a rate of increase over time of the pressure in said tank detected by said pressure detecting unit such that the number of said plurality of air compressors to be operated decreases more significantly when the rate of increase is high as compared to when the rate of increase is low, and said control unit controls such that the number of said plurality of air compressors to be operated is decreased at lower pressure in the tank, when the rate of increase is high as compared to when the rate of increase is low;

said control unit controls the number of said plurality of air compressors to be operated according to a magnitude of a rate of decrease over time of the pressure in said tank detected by said pressure detecting unit such that the number of said plurality of air compressors to be operated increases more significantly when the rate of decrease is high as compared to when the rate of decrease is low;

said control unit controls a tank pressure threshold value such that the tank pressure threshold value increases as the rate of decrease decreases; and the control unit increases the number of said plurality of air compressors to be operated when the pressure in said tank is lower than the tank pressure threshold value.

10. The control system according to claim 2, wherein said control unit decreases the number of said plurality of air compressors to be operated when the increasing rate has exceeded a predetermined increasing rate.

11. The control system according to claim 2, wherein said control unit controls the number of said plurality of air compressors to be operated according to a magnitude of a decreasing rate per unit time of the pressure in said tank detected by said pressure detecting unit such that the number of said plurality of air compressors to be operated increases more significantly when the decreasing rate is high as compared to when the decreasing rate is low.

12. The control system according to claim 2, wherein said control unit maintains a present operating condition when a cycle consisting of an uptime and a downtime of one of said plurality of air compressors is shorter than a predetermined cycle time.

13. The control system according to claim 2, wherein said control unit stops all of said plurality of air compressors when the pressure in said tank has reached a predetermined upper limit pressure.

14. The control system according to claim 2, wherein said control unit operates all of said plurality of air compressors when the pressure in said tank is lower than a predetermined lower limit pressure.

* * * * *